US007121261B2

(12) United States Patent
Kinose

(10) Patent No.: US 7,121,261 B2
(45) Date of Patent: Oct. 17, 2006

(54) FUEL SUPPLY APPARATUS FOR INTERNAL COMBUSTION ENGINE

(75) Inventor: Kenichi Kinose, Okazaki (JP)

(73) Assignee: Toyoto Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/362,164

(22) Filed: Feb. 27, 2006

(65) Prior Publication Data

US 2006/0207563 A1 Sep. 21, 2006

(30) Foreign Application Priority Data

Mar. 18, 2005 (JP) ..... 2005-078482

(51) Int. Cl.
*F02B 7/00* (2006.01)
*F02B 3/00* (2006.01)

(52) U.S. Cl. ..... 123/431; 123/446

(58) Field of Classification Search ..... 123/431, 123/304, 299–300, 575, 446, 457–458, 510–511
See application file for complete search history.

(56) References Cited

U.S. PATENT DOCUMENTS

| | | | | |
|---|---|---|---|---|
| 7,007,662 | B1 * | 3/2006 | Sakai et al. | 123/299 |
| 7,051,713 | B1 * | 5/2006 | Mashiki | 123/431 |
| 2003/0041838 | A1 | 3/2003 | Tsuchiya | |
| 2005/0098155 | A1 * | 5/2005 | Yamazaki et al. | 123/431 |
| 2005/0268889 | A1 * | 12/2005 | Kojima et al. | 123/458 |
| 2006/0027213 | A1 * | 2/2006 | Nomura et al. | 123/458 |
| 2006/0075992 | A1 * | 4/2006 | Akita et al. | 123/431 |
| 2006/0102149 | A1 * | 5/2006 | Furusawa et al. | 123/446 |

FOREIGN PATENT DOCUMENTS

| | | |
|---|---|---|
| EP | 1136686 | 9/2001 |
| EP | 1571320 | 9/2005 |
| JP | A 7-103048 | 4/1995 |
| JP | A 2001-27164 | 1/2001 |
| JP | A 2001-336439 | 12/2001 |
| JP | A 2003-278624 | 10/2003 |

* cited by examiner

*Primary Examiner*—Hai Huynh
(74) *Attorney, Agent, or Firm*—Oliff & Berridge, PLC

(57) ABSTRACT

A high pressure fuel pump boosts the pressure of fuel to discharge a quantity according to the closing period of an electromagnetic spill valve. A fuel distributor pipe receives and delivers to an in-cylinder injector the fuel discharged from the high pressure fuel pump. A fuel pressure sensor measures a fuel pressure Pt in a fuel distributor pipe. The control of open/closure of the electromagnetic spill valve according to the insufficient fuel pressure with respect to the target pressure of fuel pressure Pt is carried out in a manner similar to that of in-cylinder injection execution even during an in-cylinder injection suppressing period in which fuel is not injected from the in-cylinder injector. Accordingly, fuel pressure can be controlled at high accuracy during the in-cylinder injection suppressing period and subsequent in-cylinder injection resuming time.

12 Claims, 8 Drawing Sheets

FUEL SUPPLY APPARATUS FOR INTERNAL COMBUSTION ENGINE

This nonprovisional application is based on Japanese Patent Application No. 2005-078482 filed with the Japan Patent Office on Mar. 18, 2005, the entire contents of which are hereby incorporated by reference.

BACKGROUND OF THE INVENTION

1. Field of the Invention

The present invention relates to a fuel supply apparatus for an internal combustion engine, and more particularly to a fuel supply apparatus for an internal combustion engine including a first fuel injection mechanism for injecting fuel into a cylinder (in-cylinder injector) and a second fuel injection mechanism for injecting fuel towards an intake manifold and/or an intake port (intake manifold injector).

2. Description of the Background Art

There is known a fuel supply apparatus (fuel injection apparatus) including an intake manifold injector for injecting fuel into an intake port and an in-cylinder injector for injecting fuel into a cylinder to inject fuel by a combination of intake manifold injection and in-cylinder direct injection by controlling the intake manifold injector and in-cylinder injector in accordance with the driving state.

Such a fuel supply apparatus must have the fuel injection pressure from the in-cylinder injector increased in order to directly inject fuel into a cylinder. To this end, there is disclosed a configuration of discharging fuel from a fuel pump through a low pressure fuel pump common to a high pressure fuel supply system for in-cylinder injection and a low pressure fuel supply system for intake manifold injection, wherein the fuel from the low pressure fuel pump is further boosted by a high pressure fuel pump at the high pressure fuel supply system to be supplied to the in-cylinder injector (for example, Japanese Patent Laying-Open No. 2001-336439; referred to as Patent Document 1 hereinafter).

Patent Document 1 discloses the technique of appropriately setting the fuel injection ratio between the fuel injection quantity towards the cylinder and the fuel injection quantity into the intake manifold, taking into account atomization of the injected fuel in the cylinder in an internal combustion engine including the fuel supply apparatus set forth above.

In the internal combustion engine, the fuel injection ratio between the in-cylinder injector and intake manifold injector changes according to the state of the internal combustion engine. In order to inject fuel properly from the in-cylinder injector according to such a fuel injection ratio, the configuration of controlling the fuel pressure at the target pressure is important in the high pressure fuel supply system. If the fuel pressure is not controlled at the target pressure, burning will be degraded due to change in the atomization state and/or the fuel injection quantity, leading to the possibility of unstable output from the internal combustion engine.

Particularly in the internal combustion engine set forth above, an in-cylinder injection suppressing period during which fuel injection from the in-cylinder injector is suppressed will occur according to the setting of the fuel injection ratio. The controllability of the fuel pressure at the time of the in-cylinder injection suppressing period and at the time of resuming in-cylinder injection will become an issue in order to conduct fuel injection properly at the time of resuming fuel injection from the in-cylinder injector subsequent to the in-cylinder injection suppressing period.

SUMMARY OF THE INVENTION

An object of the present invention is to provide a fuel supply apparatus for an internal combustion engine including a first fuel injection mechanism (in-cylinder injector) for injecting fuel towards an in-cylinder and a second fuel injection mechanism (intake manifold injector) for injecting fuel towards an intake manifold and/or intake port, capable of controlling at high accuracy the pressure of fuel injected from the in-cylinder injector particularly during an in-cylinder injection suppressing period and the subsequent in-cylinder injection resuming time.

A fuel supply apparatus for an internal combustion engine according to the present invention includes a first fuel injection mechanism, a second fuel injection mechanism, a fuel injection ratio control portion, a fuel pump, a fuel delivery pipe, a pressure measurement unit, and a fuel pressure control portion. The first fuel injection mechanism is provided to inject fuel into a cylinder of the internal combustion engine. The second fuel injection mechanism is provided to inject fuel into an intake manifold of the internal combustion engine. The fuel injection ratio control portion is configured to control the ratio of the fuel injection quantity between the first fuel injection mechanism and second fuel injection mechanism with respect to the total fuel injection quantity of the internal combustion engine based on a required condition of the internal combustion engine. The fuel pump boosts the pressure of the fuel to discharge a quantity according to the open and closure control. The fuel delivery pipe is provided to receive and deliver to the first fuel injection mechanism the fuel discharged from the fuel pump. The pressure measurement unit measures the fuel pressure inside the fuel delivery pipe. The fuel pressure control portion is configured to control the open/closure of a metering valve according to the insufficient fuel pressure with respect to a target pressure of the measured fuel pressure by the pressure measurement unit. Particularly, the fuel pressure control portion controls the open/closure of the metering valve such that fuel of boosted pressure is discharged from the fuel pump when the measured fuel pressure is not more than the target pressure even in the in-cylinder injection suppressing period during which fuel is not injected from the first fuel injection mechanism.

According to the fuel supply apparatus for an internal combustion engine set forth above, the metering valve is opened/closed according to the insufficient fuel pressure when the fuel pressure does not exceed the target pressure to control the fuel pressure even during the in-cylinder injection suppressing period. Therefore, the fuel pressure in the fuel delivery pipe (high pressure delivery pipe) can be maintained at the target pressure and above even during the in-cylinder injection suppressing period. At the time of initiating fuel injection from the first fuel injection mechanism (in-cylinder injector) subsequent to the in-cylinder injection suppressing period, fuel can be injected properly from the first fuel injection mechanism with no delay in the control of the fuel pressure.

In the fuel supply apparatus for an internal combustion engine according to the present invention, the fuel pressure control portion preferably includes a fuel pressure determination portion, a first open and closure control portion, and a second open and closure control portion. The fuel pressure determination portion is configured to determine as to whether the fuel pressure is in a pressure ensured state or a pressure insufficient state by comparison between the measured fuel pressure and target pressure during the in-cylinder injection suppressing period. The first open and closure control portion is configured to control the open/closure of the metering valve such that the quantity of fuel discharged from the fuel pump attains a predetermined fixed value when determination is made of the pressure insufficient state by the fuel pressure determination portion. The second open and closure control portion is configured to control the open/closure of the metering valve such that the quantity of fuel discharged from the fuel pump is substantially zero when determination is made of the pressure ensured state by the fuel pressure determination portion.

In the in-cylinder injection suppressing period during which fuel is not consumed by the first fuel injection mechanism (in-cylinder injection injector) in accordance with the fuel supply apparatus for an internal combustion engine set forth above, the quantity of fuel discharged from the fuel pump at a pressure insufficient state is set at a predetermined fixed value. Accordingly, excessive increase of the fuel pressure during the in-cylinder injection suppressing period can be prevented. Thus, fuel can be injected more stably from the first fuel injection mechanism at the time of initiating fuel injection from the first fuel injection mechanism subsequent to the in-cylinder injection suppressing period by a simple control configuration without switching the control gain.

Further preferably, the target pressure during the in-cylinder injection suppressing period in the fuel supply apparatus for an internal combustion engine of the present invention is set at a different value for each of the pressure ensured state and pressure insufficient state. The target pressure in the pressure ensured state is set at a value lower than that of the target pressure in a pressure insufficient state.

In accordance with the fuel supply apparatus for an internal combustion engine set forth above, hysteresis can be provided at the transition between a pressure ensured state in which the quantity of fuel discharged from the fuel pump is set to substantially zero and a pressure insufficient state in which the quantity of fuel discharged from the fuel pump is set at a predetermined fixed value. Therefore, the fuel pressure can be maintained stably during the in-cylinder fuel suppressing period upon preventing unstable operation of the fuel pump caused by intermittent change in the operation of the fuel pump during the in-cylinder injection suppressing period.

In the fuel supply apparatus for an internal combustion engine of the present invention, the fuel pressure control portion particularly controls the open/closure of the metering valve further in accordance with the fuel injection quantity from the first fuel injection mechanism, in addition to the insufficient fuel pressure of the fuel pressure.

In accordance with the fuel supply apparatus for an internal combustion engine set forth above, fuel pressure control can be conducted based on the combination of feedback control by the insufficient fuel pressure with respect to the target pressure and feed forward control reflecting change in the fuel injection quantity from the first fuel injection mechanism (in-cylinder injector). In the case where fuel consumption at the first fuel injection mechanism increases, the metering valve can be controlled so as to reflect increase in fuel consumption at the first fuel injection means in advance instead of after the measured fuel pressure is reduced by actual fuel consumption. As a result, the fuel pressure can be controlled at high accuracy to allow fuel to be injected more stably from the first fuel injection mechanism.

A fuel supply apparatus for an internal combustion engine according to another configuration of the present invention includes a first fuel injection mechanism, a second fuel injection mechanism, a fuel injection ratio control portion, a fuel pump, a fuel delivery pipe, a pressure measurement unit, and a fuel pressure control portion. The first fuel injection mechanism is provided to inject fuel into a cylinder of the internal combustion engine. The second fuel injection mechanism is provided to inject fuel into an intake manifold of the internal combustion engine. The fuel injection ratio control portion is configured to control the ratio of the quantity of fuel injection between the first fuel injection mechanism and second fuel injection mechanism with respect to the total fuel injection quantity at the internal combustion engine based on a required condition of the internal combustion engine. The fuel pump boots the pressure of the fuel to discharge a quantity according to the open/closure control of a metering valve. The fuel delivery pipe is provided to receive and deliver to the first fuel injection mechanism the fuel discharged from the fuel pump. The pressure measurement unit measures the fuel pressure in the fuel delivery pipe. The fuel pressure control portion is configured to control the open/closure of the metering valve according to an insufficient fuel pressure with respect to the target pressure of the measured fuel pressure by the pressure measurement unit and the setting value of the fuel injection quantity from the first fuel injection mechanism.

According to the fuel supply apparatus for an internal combustion engine set forth above, fuel pressure control can be conducted based on a combination of feedback control by insufficient fuel pressure with respect to the target fuel pressure and feed forward control reflecting change in the fuel injection quantity setting value from the first fuel injection mechanism (in-cylinder injector). Therefore, the fuel consumption at the first fuel injection mechanism can be reflected to control the metering valve. In the case where fuel consumption at the first fuel injection mechanism increases, the metering valve can be controlled so as to reflect increase in fuel consumption at the first fuel injection mechanism in advance instead of after the measured fuel pressure is reduced by actual fuel consumption. As a result, the fuel pressure can be controlled at high accuracy to allow fuel to be injected more stably from the first fuel injection mechanism.

In the fuel supply apparatus for an internal combustion engine according to another configuration of the present invention, the fuel pressure control portion preferably calculates the fuel injection quantity setting value from the first fuel injection mechanism according to the product of the total fuel injection quantity at the internal combustion engine and the fuel injection ratio set by the fuel injection ratio control portion.

According to the fuel supply apparatus for an internal combustion engine set forth above, the fuel injection quantity setting value from the first fuel injection mechanism can be calculated through a simple process by the fuel pressure control portion.

According to the fuel supply apparatus for an internal combustion engine including first fuel injection mechanism (in-cylinder injector) for injecting fuel towards an in-cylinder and second fuel injection mechanism (intake manifold injector) for injecting fuel towards an intake manifold and/or intake port engine of the present invention, the pressure of fuel injected from the in-cylinder injector can be controlled at high accuracy particularly during an in-cylinder injection suppressing period and the subsequent in-cylinder injection resuming time.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
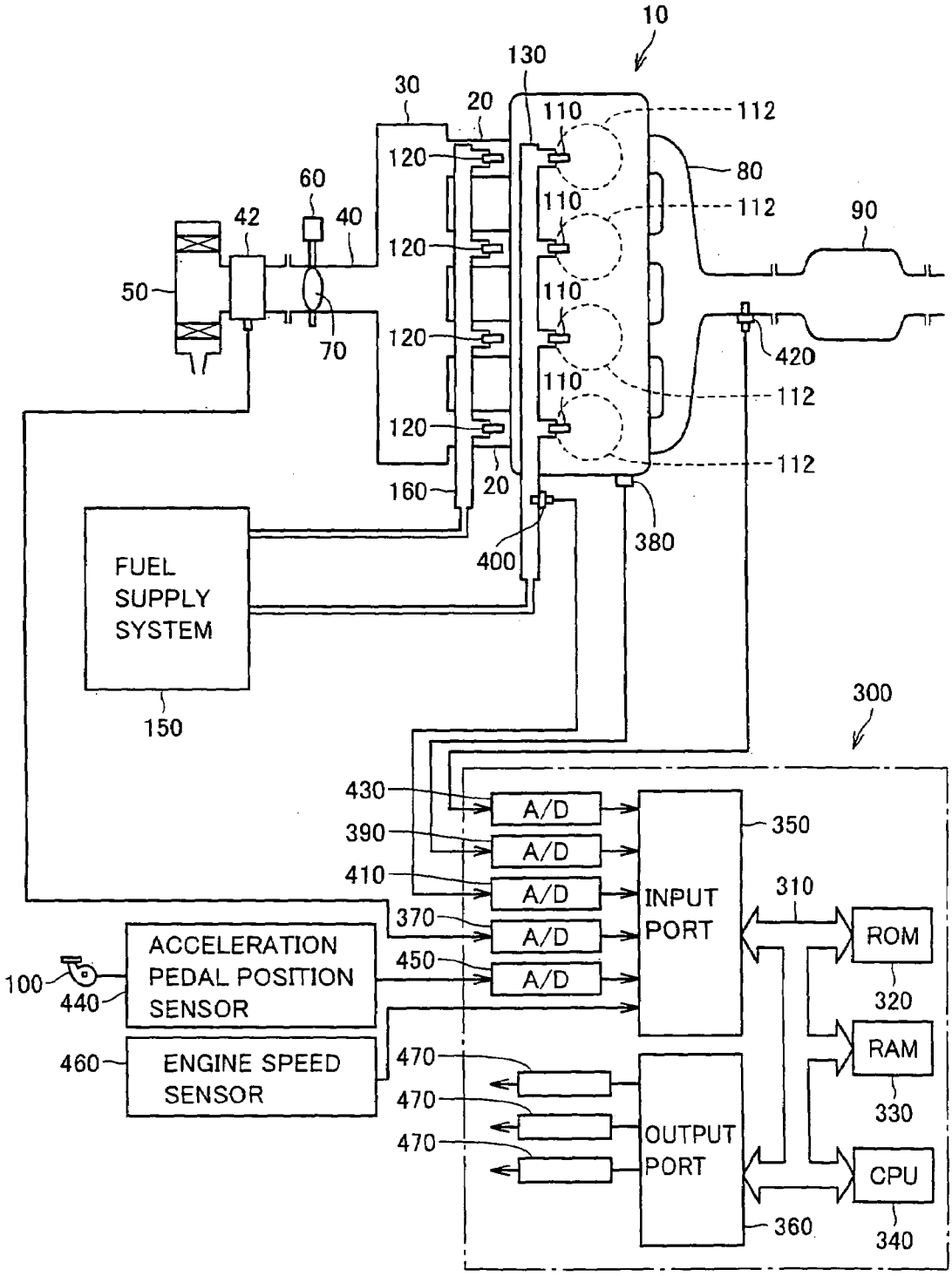
FIG. 1 is a schematic diagram of an engine system configured with a fuel supply apparatus according to an embodiment of the present invention.

Embodiments of the present invention will be described in detail hereinafter with reference to the drawings. The same or corresponding elements in the drawings have the same reference characters allotted, and details of the description will basically not be repeated.

First Embodiment

FIG. 1 is a schematic view of a configuration of an engine system configured with a fuel supply system according to an embodiment of the present invention. Although a straight four-gasoline engine is shown in FIG. 1, application of the present invention is not limited to such an engine.

Referring to FIG. 1, an engine (internal combustion engine) 10 includes four cylinders 112. Each cylinder 112 is connected to a common surge tank 30 via a corresponding intake manifold 20. Surge tank 30 is connected to an air cleaner 50 via an intake duct 40. In intake duct 40 are arranged an air flow meter 42 and a throttle valve 70 driven by a motor 60. Throttle valve 70 has its opening controlled based on an output signal from an engine ECU (Electronic Control Unit) 300 independent of an accelerator peddle 100. Each cylinder 112 is linked to a common exhaust manifold 80, which is linked to a 3-way catalytic converter.

Each cylinder 112 is provided with an in-cylinder injector 110 to inject fuel towards a cylinder, and an intake manifold injector 120 to inject fuel towards an intake port and/or intake manifold.

Injectors 110 and 120 are controlled based on output signals of the engine ECU. Each in-cylinder injector 110 is connected to a common fuel delivery pipe 130 (hereinafter, also referred to as high pressure delivery pipe). Each intake manifold injector 120 is connected to a common fuel delivery pipe 160 (hereinafter, also referred to as low pressure delivery pipe). Fuel supply to fuel delivery pipes 130 and 160 is executed by a fuel supply system 150 that will be described in detail hereinafter.

Engine ECU 300 is formed of a digital computer, including a ROM (Read Only Memory) 320, a RAM (Random Access Memory) 330, a CPU (Central Processing Unit) 340, an input port 350 and an output port 360, connected to each other via a bidirectional bus 310.

Air flow meter 42 generates an output voltage in proportion to the intake air. The output voltage from air flow meter 42 is applied to input port 350 via an A/D converter 370. A coolant temperature sensor 380 producing an output voltage in proportion to the engine coolant temperature is attached to engine 10. The output voltage from coolant temperature sensor 380 is applied to input port 350 via an A/D converter 390.

A fuel pressure sensor 400 producing an output voltage in proportion to the fuel pressure in high pressure delivery pipe 130 is attached to high pressure delivery pipe 130. The output voltage from fuel pressure sensor 400 is applied to input port 350 via an A/D converter 410. An air-fuel ratio sensor 420 producing an output voltage in proportion to the oxygen concentration in the exhaust gas is attached to exhaust manifold 80 upstream of 3-way catalytic converter 90. The output voltage from air-fuel ratio 420 is applied to input port 350 via an A/D converter 430.

Air-fuel ratio sensor 420 in the engine system of the present embodiment is a full-range air-fuel ratio sensor (linear air-fuel ratio sensor) producing an output voltage in proportion to the air-fuel ratio of air-fuel mixture burned at engine 10. Air-fuel ratio sensor 420 may be an $O_2$ sensor that detects whether the air-fuel ratio of air-fuel mixture burned at engine 10 is rich or lean to the theoretical air fuel ratio in an on/off manner.

An accelerator pedal position sensor 440 producing an output voltage in proportion to the pedal position of an accelerator pedal 100 is attached to accelerator pedal 100. The output voltage from accelerator pedal position sensor 440 is applied to input port 350 via an A/D converter 450. An engine speed sensor 460 generating an output pulse representing the engine speed is connected to input port 350. ROM 320 of engine ECU 300 stores the value of the fuel injection quantity set corresponding to a driving state, a correction value based on the engine coolant temperature, and the like that are mapped in advance based on the engine load factor and engine speed obtained through accelerator pedal position sensor 440 and engine speed sensor 460 set forth above.

Engine ECU 300 generates various control signals to control the overall operation of the engine system based on signals from respective sensors through an execution of a predetermined program. These control signals are delivered to the equipment and circuit group constituting the engine system via output port 360 and a drive circuit 470.

Figure 2:
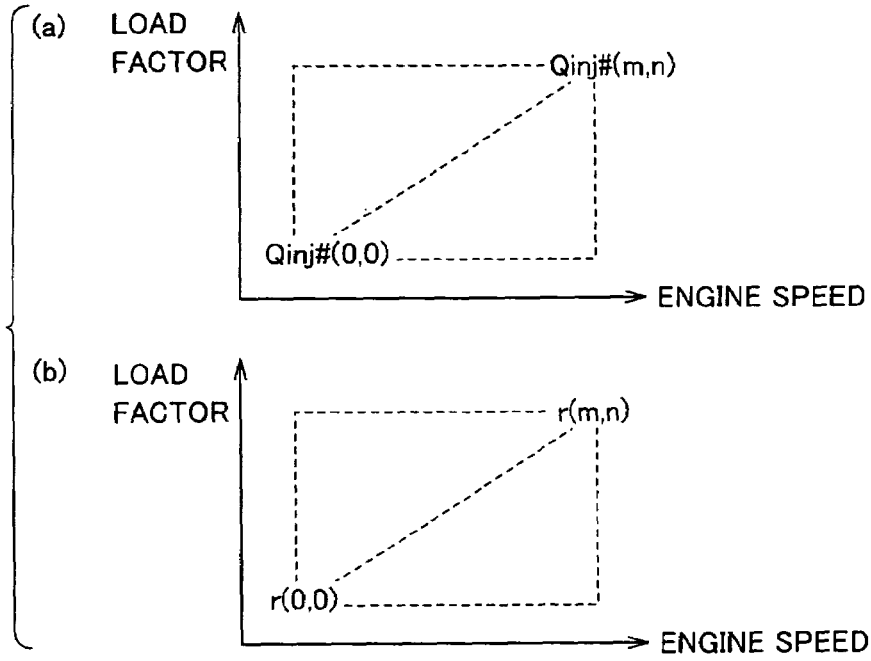
FIG. 2 is a schematic diagram for describing a configuration of a map in association with fuel injection quantity setting control at the engine system of FIG. 1.

Engine ECU 300 calculates an total fuel injection quantity Qinj# according to the driving state based on the engine load factor and engine speed. For example, total fuel injection quantity Qinj# is produced by a selective setting from map values Qinj# (0, 0) to Qinj# (m, n) on the two dimensional map of the engine speed-load factor, as shown in FIG. 2 (*a*), according to the current operation condition of engine 10.

Further, engine ECU 300 sets a DI ratio r representing the fuel injection quantity ratio between in-cylinder injector 110 and intake manifold injector 120 with respect to total fuel injection quantity Qinj# according to the engine speed and load factor of engine 10 in a normal driving state mode. The DI ratio is selectively set from map values r (0, 0) to r (m, n) according to the current operation state of engine 10 by referring to the two dimensional map of engine speed-load factor, as shown in FIG. 2 (*b*), for example.

It is assumed that "DI ratio r=100%" represents the state where fuel injection is conducted from only in-cylinder injector 110, whereas "DI ratio r=0%" represents the state where fuel injection is conducted from only intake manifold injector 120. It is also assumed that "DI ratio r≠0%", "DI ratio r≠100%" and "0%<DI ratio r<100%" represent the state where both in-cylinder injector 110 and intake manifold injector 120 partake in the fuel injection.

In-cylinder injector 110 contributes to boosting of the output performance whereas intake manifold injector 120 contributes to improving evenness of the air-fuel mixture. By selectively operating two types of injectors differing in such properties depending upon the engine speed and load factor of the internal combustion engine, homogenous combustion operation is mainly conducted during a normal driving state (normal operation) of the internal combustion engine (for example, a catalyst warm up state during idling can be taken as an example of an exceptional state besides the normal operation). Setting of a preferable DI ratio r will be described in detail afterwards.

A configuration of the fuel supply system of the engine system of FIG. 1 will be described hereinafter.

Figure 3:
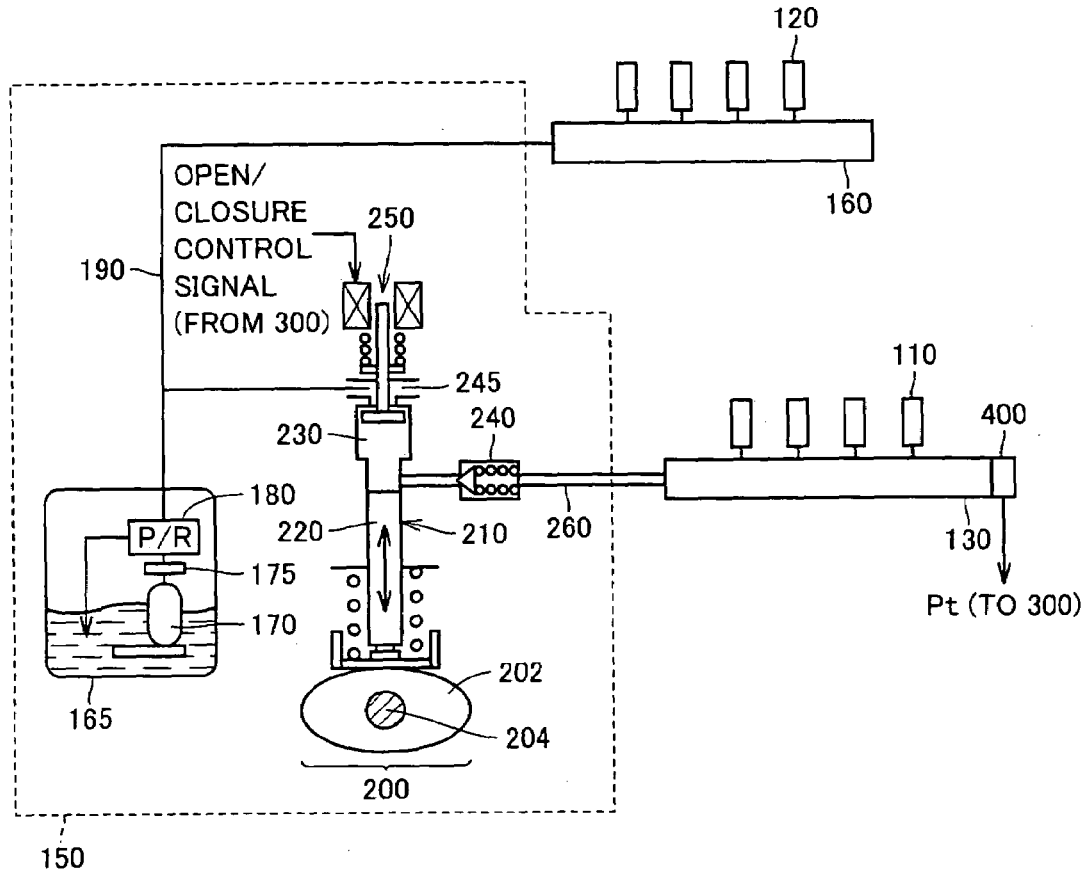
FIG. 3 is a block diagram to describe a configuration of the fuel supply system of FIG. 1.

FIG. 3 is a block diagram representing a configuration of fuel supply system 150 of FIG. 1.

In FIG. 3, components other than in-cylinder injectors 110, high pressure delivery pipe 130, intake manifold injectors 120 and low pressure delivery pipe 160 correspond to fuel supply system 150 of FIG. 1.

Low pressure fuel pump 170 discharges the suction fuel from fuel tank 165 at a predetermined pressure (low pressure set value). The fuel output from low pressure fuel pump 170 is delivered under pressure to low pressure fuel channel 190 via a fuel filter 175 and a fuel pressure regulator 180. Fuel pressure regulator 180 is open when the fuel pressure of the low pressure system is to be boosted to form a channel through which the fuel in the proximity of fuel pressure regulator 180 in low pressure fuel channel 190, i.e. the fuel just drawn up by low pressure fuel pump 170, is returned to fuel tank 165. Accordingly, the fuel pressure of low pressure fuel channel 190 is set at a predetermined pressure. The fuel returned to fuel tank 165 can prevent temperature rise in fuel tank 165 since it has just being drawn up from fuel tank 165.

A cylinder head (not shown) is attached to high pressure fuel pump 200 to drive a plunger 220 in a pump cylinder 210 back and forth through the rotary drive of a pump cam 202 provided at a cam shaft 204 for the intake valve (not shown) or exhaust valve (not shown) of engine 10. High pressure fuel pump 200 further includes a high pressure pump chamber 230 partitioned by a pump cylinder 210 and plunger 220, a gallery 245 linked with low pressure fuel channel 190, and an electromagnetic spill valve 250 identified as a "metering valve". Electromagnetic spill valve 250 is opened/closed to control the communication/cutoff between gallery 245 and high pressure pump chamber 230.

The discharge side of high pressure fuel pump 200 is linked to a high pressure delivery pipe 130 that delivers fuel towards in-cylinder injector 110 via high pressure fuel channel 260. High pressure fuel channel 260 is provided with a check valve (non-return valve) 240 restricting the fuel from flowing back towards high pressure fuel pump 200. The intake side of high pressure fuel pump 200 is linked with low pressure fuel pump 170 provided in fuel tank 160 via low pressure fuel channel 190.

Figure 4:
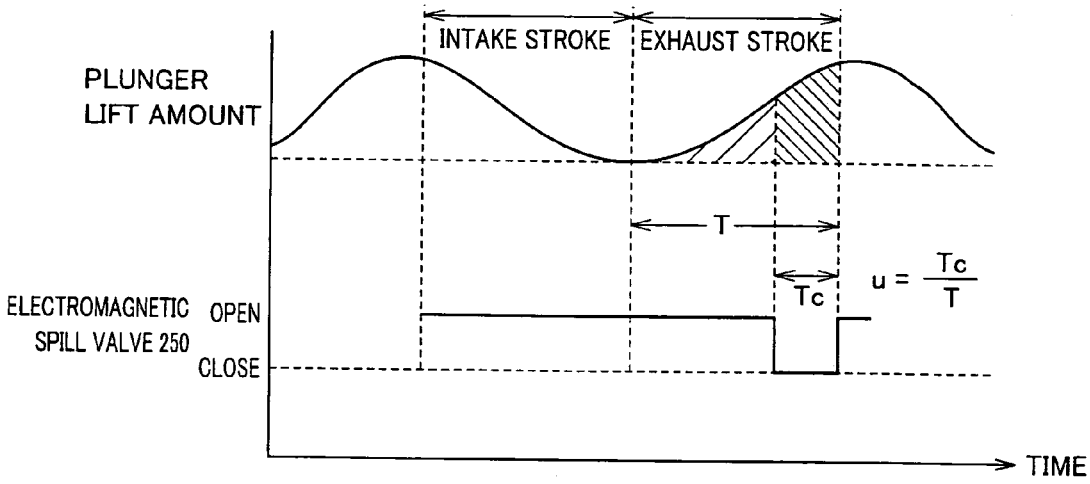
FIG. 4 is a schematic diagram to describe an operation of a high pressure fuel pump of FIG. 3.

Referring to FIG. 4, in the intake stroke during which the lift of plunger 220 is reduced according to the rotation of pump cam 202, the volume of high pressure pump chamber 230 increases by the reciprocation drive of plunger 220. In the intake stroke, electromagnetic spill valve 250 is maintained at an open state.

Referring to FIG. 3 again, fuel is drawn in from low pressure fuel channel 190 via gallery 245 into high pressure pump chamber 230 in an intake stroke since gallery 245 communicates with high pressure pump chamber 230 during the open period of electromagnetic spill valve 250.

Referring to FIG. 4 again, the volume of high pressure pump chamber 230 is reduced by the reciprocating drive of plunger 220 in the exhaust stroke during which the lift of plunger 220 is increased according to rotation of pump cam 202. In the exhaust stroke, the open/closure of electromagnetic spill valve 250 is controlled by an open/closure control signal from engine ECU 300.

Referring to FIG. 3 again, the fuel drawn into high pressure pump 230 flows out towards low pressure fuel channel 190 via gallery 245 since gallery 245 communicates with high pressure pump chamber 230 during the open period of electromagnetic spill valve 250 in the exhaust stroke. In other words, the fuel is discharged back towards low pressure fuel channel 190 via gallery 245 without being delivered to high pressure delivery pipe 130 via high pressure fuel channel 260.

During the close period of electromagnetic spill valve 250, gallery 245 does not communicate with high pressure pump chamber 230. Therefore, the fuel pressurized during the exhaust stroke is delivered under pressure towards high pressure delivery pipe 130 via high pressure fuel channel 260 without flowing back to gallery 245. The measured pressure from fuel pressure sensor 400 provided at high pressure delivery pipe 130, i.e. measured fuel pressure Pt, is transmitted to engine ECU 300. The ratio of the valve close period Tc of electromagnetic spill valve 250 to exhaust stroke period T, i.e. u=Tc/T, is referred to as "duty ratio". Specifically, the fuel quantity discharged from high pressure fuel pump 200 when duty ratio u=0 becomes zero. The quantity of fuel discharged from high pressure fuel pump 200 becomes larger as the duty ratio becomes higher.

The corresponding relationship between the configuration of FIGS. 1–4 and the configuration of the present invention will be described here. In-cylinder injector 110 corresponds to "first fuel injection means" in the present invention.

Intake manifold injector 120 corresponds to "second fuel injection means" in the present invention. High pressure fuel pump 200 corresponds to "fuel pump" in the present invention. Electromagnetic spill valve 250 corresponds to "metering valve" in the present invention. Further, high pressure delivery pipe 130 corresponds to "fuel delivery pipe" and fuel pressure sensor 400 corresponds to "pressure measurement unit" in the present invention. The functional element that sets DI ratio r in engine ECU 300 according to the map of FIG. 2 (*b*) corresponds to "injection ratio setting means" in the present invention.

In accordance with the fuel supply apparatus for an internal combustion engine according to an embodiment of the present invention, fuel pressure control at the high pressure fuel supply system can be conducted through open/closure control of electromagnetic spill valve 250, specifically through duty ratio control.

Figure 5:
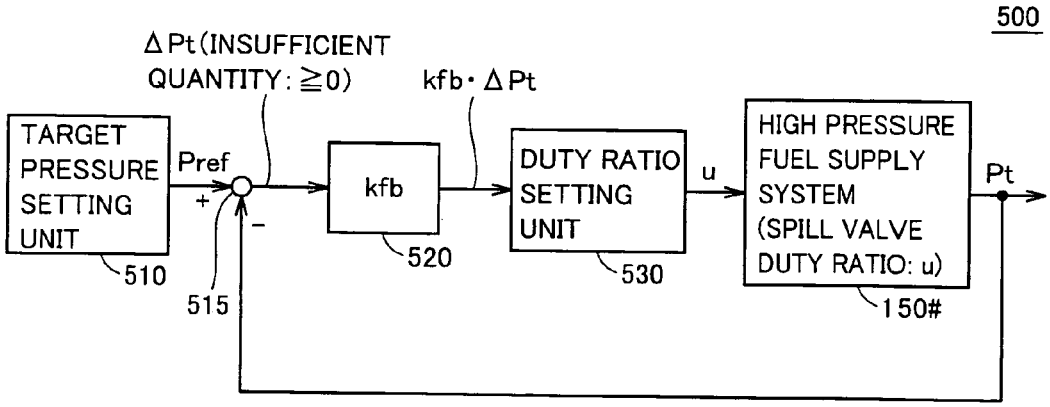
FIG. 5 is a block diagram to describe fuel pressure control according to a first embodiment at a high pressure fuel supply system of the fuel supply apparatus according to the present invention.

FIG. 5 is a block diagram representing the fuel pressure control system according to the first embodiment at the high pressure fuel supply system. The control operation according to the fuel pressure control system of FIG. 5 is realized by a control operation process programmed in advance in engine ECU 300. In other words, the functional element executing the control operation according to fuel pressure control system 500 in engine ECU 300 corresponds to "fuel pressure control means" in the present invention.

Referring to FIG. 5, fuel pressure control system 500 includes a target pressure setting unit 510, a functional unit 515, a feedback gain setting unit 520, a duty ratio setting unit 530, and a high pressure fuel supply system 150# that is the subject of control. High pressure fuel supply system 150# is comparable to high pressure fuel pump 200, high pressure fuel channel 260, and high pressure delivery pipe 130 shown in FIG. 2.

Target pressure setting unit 510 sets the target pressure Pref that is the fuel pressure target value of the high pressure fuel supply system. Target pressure Pref may be a fixed value, or may be variable according to the engine operation state or the like.

Functional unit 515 calculates the difference between the actual fuel pressure at high pressure fuel supply system 150#, i.e. measured fuel pressure Pt by fuel pressure sensor 400, and target pressure Pref to obtain the insufficient fuel pressure ΔPt of measured fuel pressure Pt with respect to target pressure Pref When the fuel pressure is ensured (when Pt≧Pref), ΔPt=0 is set. When the fuel pressure is insufficient (when Pt<Pref), ΔPt=Pref−Pt is set.

Feedback gain setting unit 520 sets feedback gain Kfb to conduct the well-known PID control and the like. Feedback gain Kfb can be set according to the general feedback control technique.

Duty ratio setting unit 530 sets the duty ratio u of electromagnetic spill valve 250 according to the control quantity Kfb·ΔPt that is indicated by the product of feedback gain Kfb and insufficient fuel pressure ΔPt based on a predetermined operational expression or map.

At high pressure fuel supply system 150#, electromagnetic spill valve (metering valve) 250 has its open/closure controlled according to the duty ratio u set by duty ratio setting unit 530. High pressure fuel pump 200 discharges the boosted-pressure fuel towards high pressure delivery pipe 130 during the closing period of electromagnetic spill valve 250. The quantity of fuel discharged from high pressure fuel pump 200 is set according to control quantity Kfb·ΔPt. By such feedback control, the fuel pressure of high pressure fuel supply system 150# is controlled at the level of target pressure Pref.

Engine ECU 300 operates fuel pressure control system 500 in the in-cylinder injection suppressing period during which the quantity of fuel injected from in-cylinder injector 110 is 0 and DI ratio r=0% is set. Accordingly, the fuel pressure at high pressure fuel supply system 150# is maintained at the target pressure even during the in-cylinder injection suppressing period. Even if the operation state changes so that the setting of DI ratio r>0% is switched, fuel injection can be conducted properly from each in-cylinder injector 110 with no control delay in fuel pressure.

Second Embodiment

The first embodiment was described in which fuel pressure control was conducted based on a control operation similar to that of in-cylinder injection execution even during an in-cylinder injection suppressing period. It is to be noted that there is no great pressure reduction factor during the in-cylinder injection suppressing period since fuel consumption caused by fuel injection from in-cylinder injector 110 is absent. If a control operation similar to that of in-cylinder injection execution is carried out, the fuel pressure will become excessive, and that excessive fuel state may continue. The second embodiment is directed to fuel pressure control taking into account such an issue.

Figure 6:
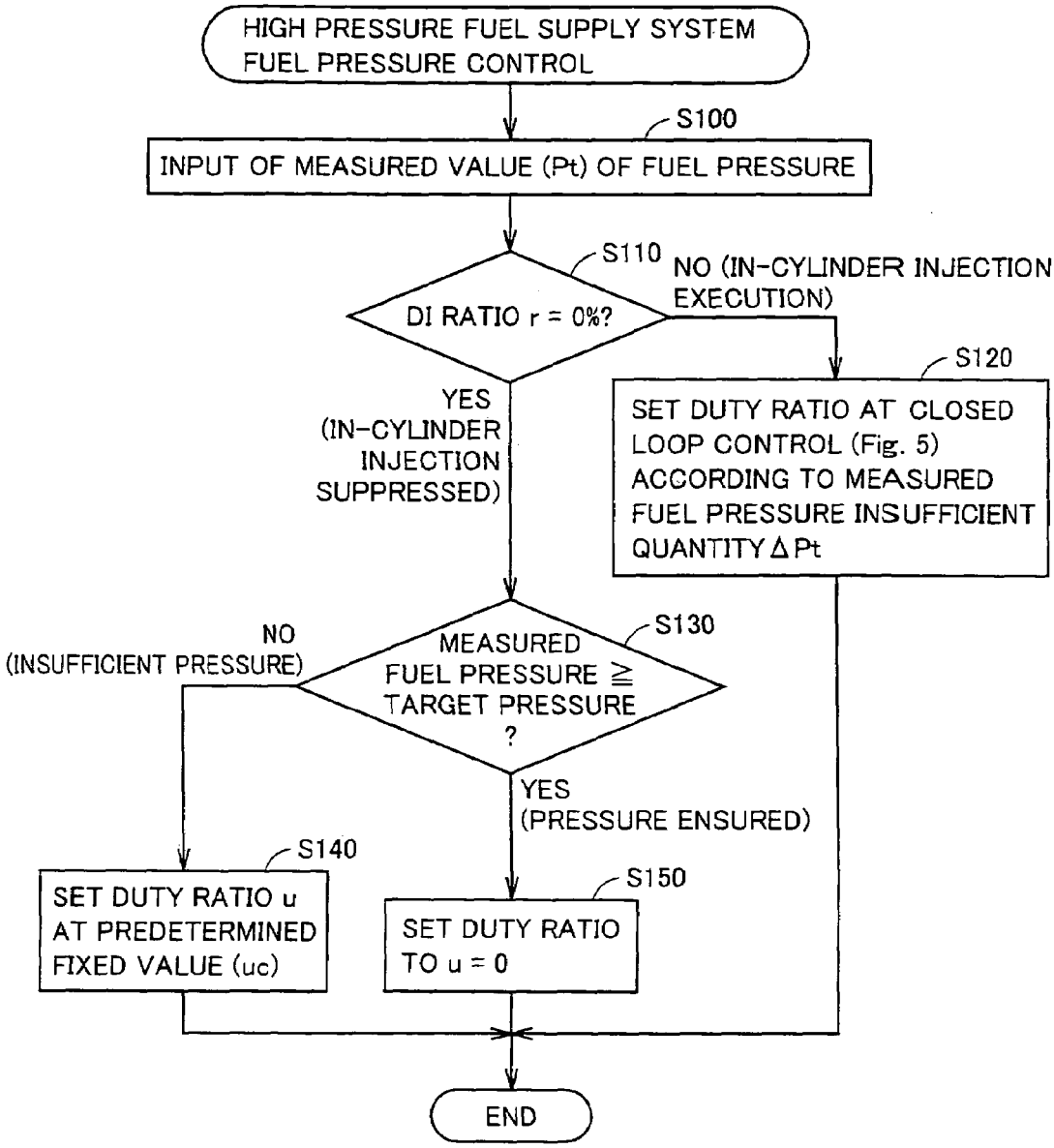
FIG. 6 is a flow chart to describe fuel pressure control according to a second embodiment at a high pressure fuel supply system of the fuel supply apparatus according to the present invention.

FIG. 6 is a flow chart describing fuel pressure control according to the second embodiment of the present invention. The fuel pressure control according to the flow chart of FIG. 6 is realized by a control operation process that is programmed in advance in engine ECU 300.

Referring to FIG. 6 corresponding to fuel pressure control of the second embodiment, measured fuel pressure Pt is input from fuel pressure sensor 400 (step S100), and then determination is made whether the engine is at an in-cylinder injection suppressing period based on DI ratio r=0% or not (step S110).

When DI ratio r≠0%, i.e. when during in-cylinder injection execution (NO at step S110), closed loop control is executed according to insufficient fuel pressure ΔPt by fuel pressure control system 500 of FIG. 5 to set duty ratio u of electromagnetic spill valve 250 (step S120).

When DI ratio r=0%, i.e. during the in-cylinder injection suppressing period (YES at step S110), measured fuel pressure Pt is compared with target pressure Pref (step S130).

When ΔPt≧Pref, i.e. when the fuel pressure is ensured (YES at step S130), the duty ratio is set to u=0 such that the quantity of fuel discharged from high pressure fuel pump 200 is substantially 0 (step S150). Therefore, fuel of boosted pressure will not be newly delivered into high pressure delivery pipe 130. As a result, the rise in pressure boosting is suppressed.

In contrast, when ΔPt<Pref, i.e. when fuel pressure is insufficient (NO at step S130), duty ratio u is set to a predetermined fixed value (uc) independent of insufficient fuel pressure ΔPt such that the quantity of fuel discharged from high pressure fuel pump 200 attains a predetermined fixed value.

Since fuel consumption does not occur at the high pressure fuel supply system during the in-cylinder injection suppressing period, the fuel pressure will not be readily reduced at the high pressure fuel supply system. Therefore, the fuel pressure can be ensured by a duty ratio lower than that of in-cylinder injection execution. Conversely, if the duty ratio u is set according to the feedback control by a gain similar to that of in-cylinder injection execution, there is a possibility of excessive fuel pressure at the high pressure fuel supply system. Therefore, the fixed duty ratio uc may be set lower than the duty ratio set by feedback control (FIG. 5) during in-cylinder injection execution. Accordingly, the quantity of fuel discharged from high pressure fuel pump 200 during the in-cylinder injection suppressing period is set relatively lower than that of other periods. Fixed duty ratio uc can be defined at an appropriate value in advance based on experiments and the like.

By such fuel pressure control, excessive fuel pressure during in-cylinder fuel injection suppress period can be prevented. Since the duty ratio is selectively set at a fixed value uc or 0 during the in-cylinder injection suppressing period, the control configuration can be simplified without switching the control gain.

The corresponding relationship between the flow chart of FIG. 6 and the configuration of the present invention will be described here. Step S130 corresponds to "fuel pressure determination means" in the present invention. Step S140 corresponds to "first open and closure control means" in the present invention. Step S150 corresponds to "second open and closure control means" in the present invention.

In accordance with the fuel pressure control of FIG. 6, the duty ratio will vary between 0 and a fixed value uc in a discontinuous (stepped) manner according to the difference between measured fuel pressure Pt and the target pressure. In the fuel pressure control of the second embodiment, the target pressure used in the determination made at step S130 takes a different value between a pressure ensured state and a pressure insufficient state. Accordingly, hysteresis can be provided at the transition between a pressure ensured state (u=0) and a pressure insufficient state (u=uc).

Figure 7:
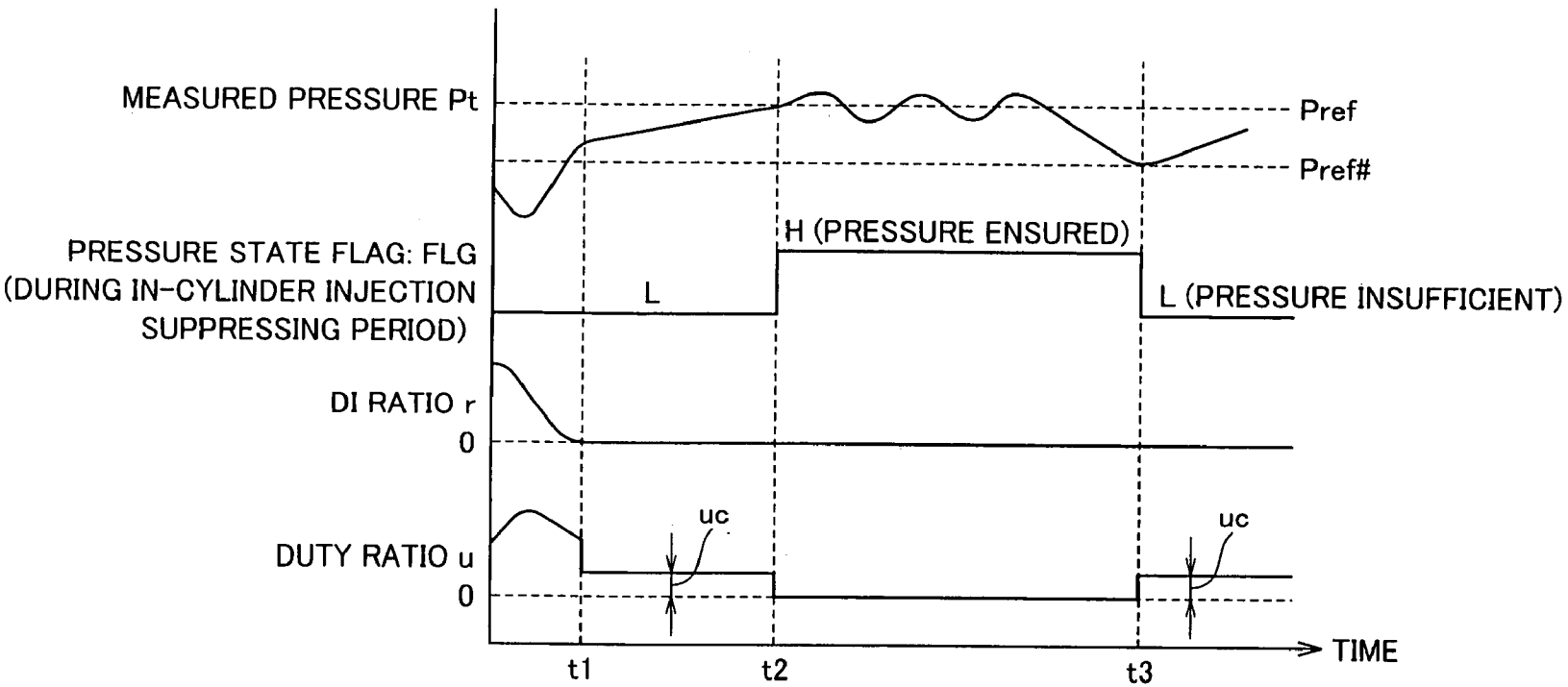
FIG. 7 is a waveform diagram representing an exemplified operation of fuel pressure control according to the second embodiment of the present invention.

Referring to the operational waveform shown in FIG. 7, DI ratio r=0% is set according to the driving condition at time t1, whereby in-cylinder injection is suppressed. During the in-cylinder injection suppressing period of DI ratio r=0%, a pressure state flag FLG is set to an L level representing a pressure insufficient state or an H level representing a pressure ensured state by comparison between measured fuel pressure Pt and the target pressure. Further, the target pressure is set to Pref at a pressure insufficient state and set to Pref# (Pref#<Pref) that is lower than the essential target pressure Pref in a pressure ensured state. The target pressure (initial value) at the start of an in-cylinder injection suppressing period is set to Pref, likewise the in-cylinder injection execution.

At time t1 corresponding to transition to an in-cylinder injection suppressing period, pressure state flag FLG=L level (pressure insufficient state) is set since Pt<Pref, and duty ratio u=uc (fixed state) at the high pressure fuel supply system is set corresponding to pressure state flag FLG=L level. Accordingly, measured fuel pressure Pt gradually rises at time t1 and et seq. to arrive at the target pressure Pref at time t2.

In response, pressure state flag FLG=H level (pressure ensured state) is established at time t2, which in turn causes duty ratio u=0 to be established from time t2.

Target pressure Pref# at a pressure ensured state is set lower than the value of target pressure Pref at a pressure insufficient state. Specifically, when Pt<Pref# is established subsequent to transition to pressure state flag FLG=H level (pressure ensured state), pressure flag FLG is set at the L level again.

Figure 8:
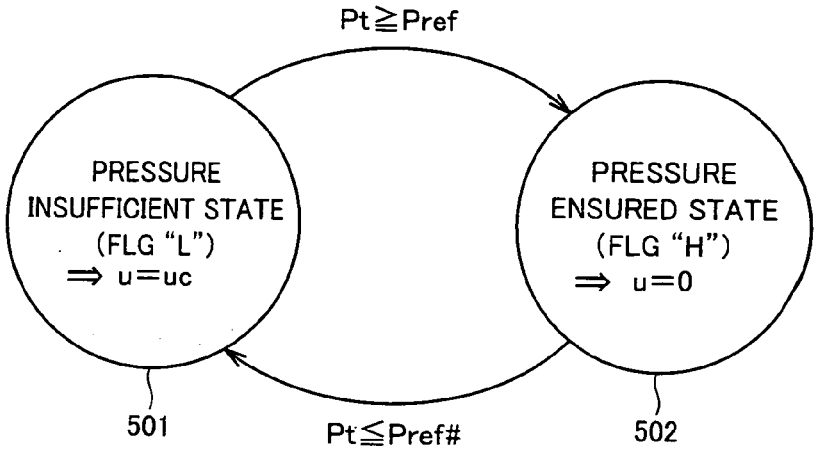
FIG. 8 is a schematic diagram to describe setting of the duty ratio of a spill valve in fuel pressure control according to the second embodiment.

In accordance with the fuel pressure control of the second embodiment shown in FIG. 8, a pressure insufficient state 501 (FLG=L level) and a pressure ensured state 502 (FLG=H level) are defined according to comparison between the measured fuel pressure Pt and the target pressure during the in-cylinder injection suppressing period, whereby duty ratio u is set at a fixed value uc or 0 corresponding to respective states. The transition condition from pressure insufficient state 501 to pressure ensured state 502 is set as Pt≧Pref, whereas the transition condition from pressure ensured state 502 to pressure insufficient state 501 is set as Pt≦Pref# (Pref#<Pref), providing a hysteresis at the transition between respective states.

Referring to FIG. 7 again, pressure state flag FLG=H level is maintained in the range of Pref#≦Pt<Pref at time t2 and et seq. Therefore, pressure state flag FLG will not change intermittently even if measured pressure value Pt varies in the vicinity of target pressure Pref Therefore, hunting of the duty ratio setting to cause unstable operation of high pressure fuel pump 200 can be prevented.

When measured fuel pressure Pt is gradually reduced thereafter to become lower than target pressure Pref#, the pressure flag is set at FLG=L level again, whereby duty ratio u is set at fixed value uc. The operation thereafter is similar to that of time t1–t2. Therefore, detailed description thereof will not be repeated.

The fuel pressure control of the second embodiment prevents excessive fuel pressure at high pressure fuel supply system 150# during an in-cylinder injection suppressing period to maintain the target pressure. Therefore, fuel injection from each in-cylinder injector 110 can be conducted properly from the switching time of the setting to DI ratio r>0% in response to change in the driving state. Further, unstable operation of high pressure fuel pump 200 during the in-cylinder injection suppressing period can be prevented.

Third Embodiment

Figure 9:
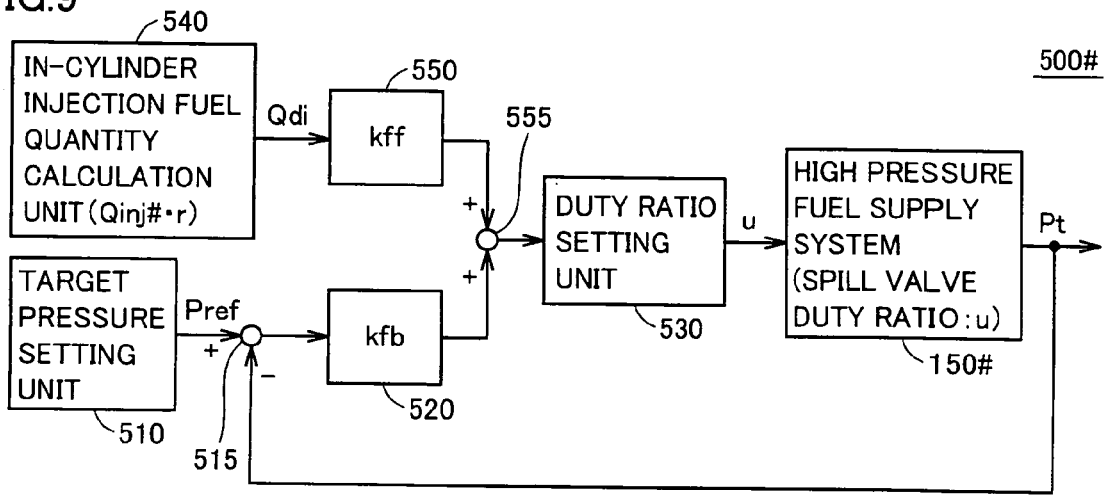
FIG. 9 is a block diagram to describe fuel pressure control according to a third embodiment at a high pressure fuel supply system of the fuel supply apparatus according to the present invention.

FIG. 9 is a block diagram showing a fuel pressure control system according to a third embodiment at a high pressure fuel supply system. The control operation of the fuel pressure control system of FIG. 9 is realized by a control operation process that is programmed in advance at engine ECU 300. The functional element executing the control operation according to fuel pressure control system 500# of engine ECU 300 corresponds to "fuel pressure control means" in the present invention.

Referring to FIG. 9, fuel pressure control system 500# according to the third embodiment of the present invention includes, in addition to the structure of fuel pressure control system 500 of FIG. 5, an in-cylinder injection fuel quantity calculation unit 540, a feed forward gain setting unit 550, and an adder 555.

In-cylinder injection fuel quantity calculation unit 540 calculates in-cylinder fuel injection quantity set value Qdi represented by a product of total fuel injection quantity Qinj# and DI ratio r. Feed forward gain setting unit 550 sets a feed forward gain Kff to conduct feed forward control according to in-cylinder injection fuel quantity. Feed forward gain Kff is set according to a general feed forward control gain technique.

Adder 555 obtains the sum of the product Kfb·ΔPt of insufficient fuel pressure ΔPt and feedback gain Kfb, and the product Kff·Qdi of feed forward gain Kff and in-cylinder fuel injection quantity set value Qdi.

At fuel pressure control system 500#, duty ratio setting unit 530 sets duty ratio u of electromagnetic spill valve (metering valve) 250 according to the output of adder 555, i.e. control quantity Kff·Qdi+Kfb·ΔPt. Specifically, the fuel pressure control of the third embodiment can implement a control system having feed forward control reflecting change in in-cylinder fuel injection quantity set value Qdi added to feed back control based on measured fuel pressure Pt as in the third embodiment.

Accordingly, the duty ratio u can be set reflecting in-cylinder fuel injection quantity set value Qdi from in-cylinder injector 110, i.e. fuel consumption at high pressure fuel supply system 150#. In the case where in-cylinder fuel injection quantity set value Qdi becomes higher, duty ratio u can be increased so as to reflect in advance increment of in-cylinder fuel injection quantity set value Qdi instead of raising duty ratio u after measured fuel pressure Pt becomes lower by actual fuel consumption. Thus, the fuel pressure of high pressure fuel supply system 150# can follow target pressure Pref at higher accuracy.

Figure 10:
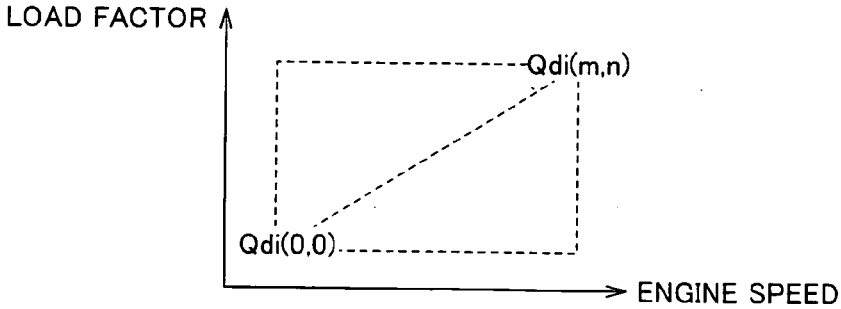
FIG. 10 is a diagram to describe an example of a map configuration employed in the in-cylinder injection fuel quantity calculation unit of FIG. 9.
Figure 11:
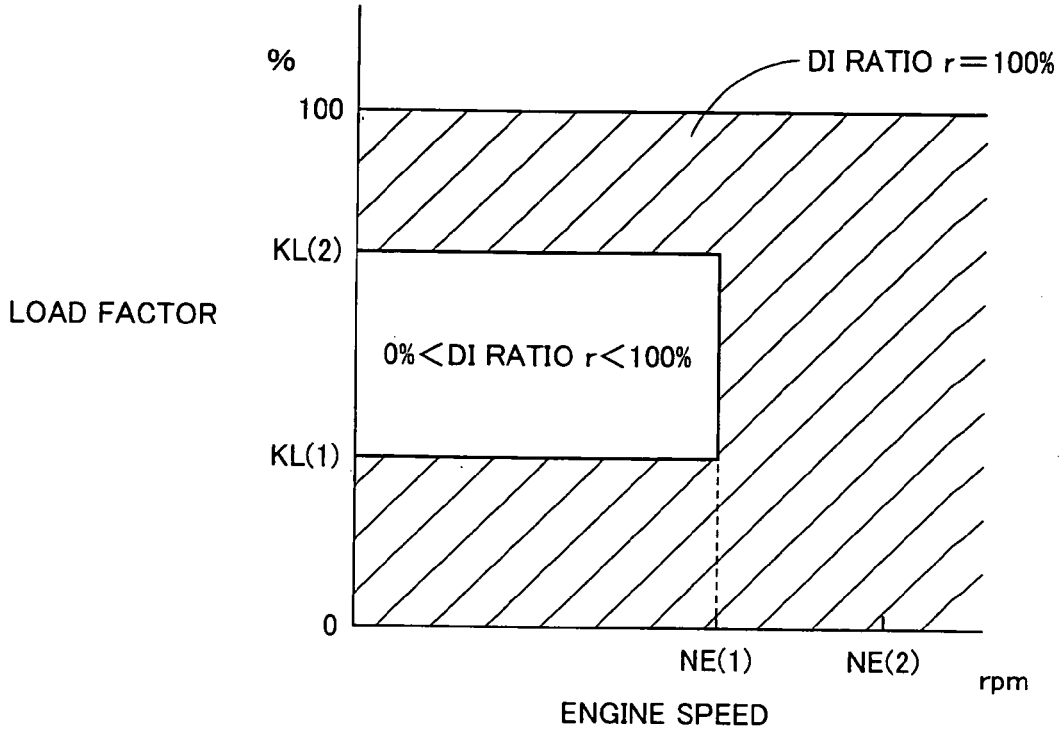
FIG. 11 is a diagram to describe a first example of a DI ratio setting map (engine warming time) in the engine system of FIG. 1.

In-cylinder injection fuel quantity calculation unit 540 can be implemented by a map as shown in FIG. 10, instead of the operation of Qinj#·r. Specifically, as shown in FIG. 2 (*a*) and (*b*), the setting map of total fuel injection quantity Qinj# and DI ratio r can be integrated to produce a secondary map of the engine speed-load factor in association with Qdi (=Qinj#·r). Specifically, in-cylinder fuel injection quantity set value Qdi can be set by selection according to the current driving state of engine 10 (engine speed and load factor) from map values Qdi (0, 0) to Qdi (m, n) by referring to the map of FIG. 11. In view of the operation load of engine ECU 300, it is preferable to calculate in-cylinder fuel injection quantity set value Qdi by referring to a map as shown in FIG. 11.

Fuel pressure control system 500# of the third embodiment can be employed in combination with the second embodiment. In other words, fuel pressure control by fuel pressure control system 500# shown in FIG. 9 can be conducted at step S120 in the flow chart of FIG. 6 for fuel pressure control.

Preferable Setting of DI ratio.

Preferable setting of the DI ratio according to the operation state of engine 10 in the engine system of FIG. 11 will be described hereinafter.

Figure 12:
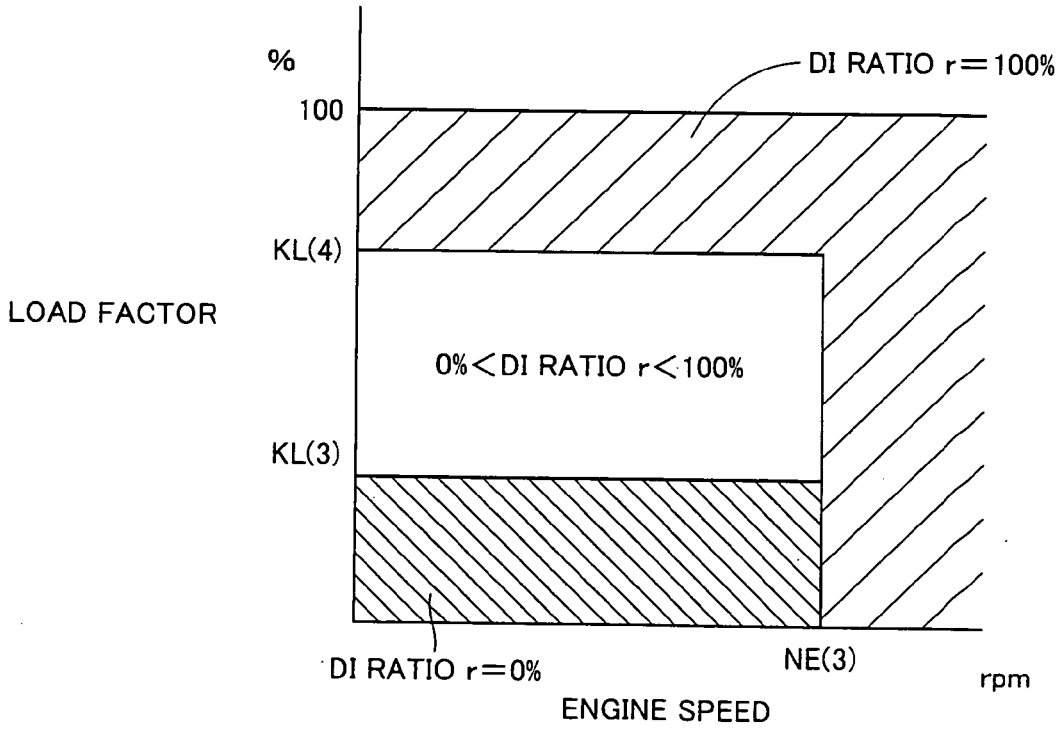
FIG. 12 is a diagram to describe the first example of a DI ratio setting map (engine cooling time) in the engine system of FIG. 1.

FIGS. 11 and 12 are diagrams to describe a first example of a setting map for the DI ratio in the engine system of FIG. 1.

The maps shown in FIGS. 11 and 12 are stored in a ROM 320 of engine ECU 300. FIG. 11 is the map for a warm state of engine 10 whereas FIG. 12 is a map for a cold state of engine 10.

In the maps of FIGS. 11 and 12, the fuel injection ratio of in-cylinder injector 110 is expressed in percentage as DI ratio r, wherein the engine speed of engine 10 is plotted along the horizontal axis and the load factor is plotted along the vertical axis.

As shown in FIGS. 11 and 12, the DI ratio r is defined for each operation region that is determined by the engine speed and load factor of engine 10, divided between a map for a warm state and a map for a cold state. The maps are configured to indicate different control regions of in-cylinder injector 110 and intake manifold injector 120 as the temperature of engine 10 changes. When the detected temperature of engine 10 is equal to or higher than a predetermined temperature threshold value, the map for a warm state shown in FIG. 11 is selected; otherwise, the map for a cold state shown in FIG. 12 is selected. In-cylinder injector 110 and/or intake manifold injector 120 are controlled according to the engine speed and load factor of engine 10 based on each selected map.

The engine speed and the load factor of engine 10 set in FIGS. 11 and 12 will now be described. In FIG. 11, NE(1) is set to 2500 rpm to 2700 rpm, KL(1) is set to 30% to 50%, and KL(2) is set to 60% to 90%. In FIG. 12, NE(3) is set to 2900 rpm to 3100 rpm. That is, NE(1)<NE(3). NE(2) in FIG. 11 as well as KL(3) and KL(4) in FIG. 12 are also set appropriately.

When comparing FIG. 11 and FIG. 12, NE(3) of the map for the cold state shown in FIG. 12 is greater than NE(1) of the map for the warm state shown in FIG. 11. This shows that, as the temperature of engine 10 is lower, the control region of intake manifold injector 120 is expanded to include the region of higher engine speed. That is, in the case where engine 10 is cold, deposits are unlikely to accumulate in the injection hole of in-cylinder injector 110 (even if the fuel is not injected from in-cylinder injector 110). Thus, the region where the fuel injection is to be carried out using intake manifold injector 120 can be expanded, allowing improvement in homogeneity.

When comparing FIG. 11 and FIG. 12, "DI ratio r=100%" is established in the region where the engine speed of engine 10 is NE(1) or higher in the map for the warm state, and in the region where the engine speed is NE(3) or higher in the map for the cold state. In terms of load factor, "DI ratio r=100%" is established in the region where the load factor is KL(2) or greater in the map for the warm state, and in the region where the load factor is KL(4) or greater in the map for the cold state. This means that in-cylinder injection 110 alone is used in the region of a predetermined high engine speed, and in the region of a predetermined high engine load. That is, in the high speed region or the high load region where fuel is injected using only in-cylinder injector 110, the engine speed and the load of engine 10 are so high with sufficient intake air quantity that a homogeneous air-fuel mixture can be obtained even with in-cylinder injector 110 alone. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby the anti-knocking performance is improved. Further, since the temperature in the combustion chamber is decreased, intake efficiency is improved, leading to high power output.

In the map for the warm state in FIG. 11, fuel injection is also carried out using in-cylinder injector 110 alone when the load factor is KL(1) or below. This shows that in-cylinder injector 110 alone is used in a predetermined low-load region when the temperature of engine 10 is high. When engine 10 is in a warmed state, deposits are likely to accumulate in the injection hole of in-cylinder injector 110. However, when fuel injection is carried out using in-cylinder injector 110, the temperature of the injection hole can be lowered, in which case accumulation of deposits is obviated. Further, clogging of in-cylinder injector 110 may be prevented while ensuring the minimum fuel injection quantity thereof. Thus, in-cylinder injector 110 solely is used in the relevant region.

When comparing FIG. 11 and FIG. 12, a region of "DI ratio r=0%" is present only in the map for the cold state in FIG. 12. This shows that fuel injection is carried out using only intake manifold injector 120 in a predetermined low-load region (KL(3) or less) when the temperature of engine 10 is low. When engine 10 is cold so that the load and intake air quantity are low, atomization of the fuel is unlikely to occur. In such a region, it is difficult to ensure favorable combustion with the fuel injection from in-cylinder injector 110. Further, particularly in the low-load and low-speed region, high output using in-cylinder injector 110 is not required. Accordingly, fuel injection is carried out using only intake manifold injector 120, rather than in-cylinder injector 110, in the relevant region.

Further, in an operation other than the normal operation, such as in the catalyst warm-up state during idling of engine 10 (an exceptional state), in-cylinder injector 110 is controlled to carry out stratified charge combustion. By causing the stratified charge combustion only during the catalyst warm-up operation, warming up of the catalyst is promoted, and exhaust emission is thus improved.

Figure 13:
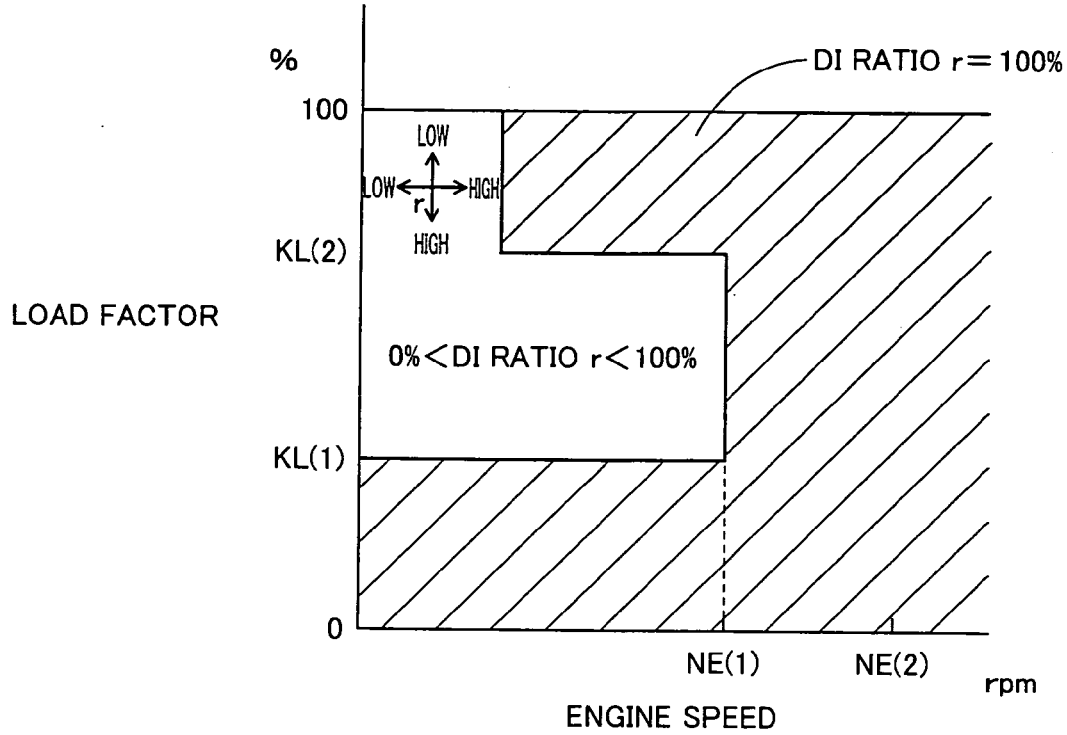
FIG. 13 is a diagram to describe a second example of a DI ratio setting map (engine warming time) in the engine system of FIG. 1.
Figure 14:
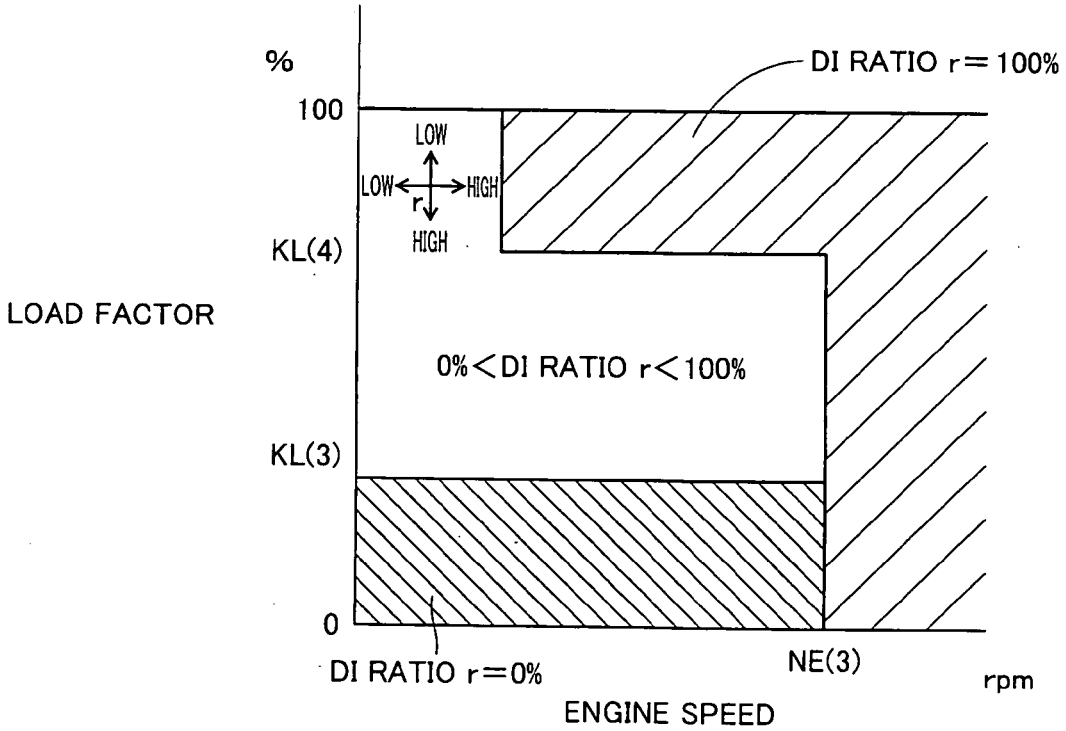
FIG. 14 is a diagram to describe the second example of a DI ratio setting map (engine cooling time) in the engine system of FIG. 1.

FIGS. 13 and 14 show a second example of a setting map of the DI ratio in the engine system of FIG. 1.

The setting maps shown in FIG. 13 (warm state) and FIG. 14 (cold state) have a different DI ratio setting at the high load region and low speed region, as compared to the setting maps shown in FIGS. 11 and 12.

In the low-speed region and high-load region of engine 10, mixing of air-fuel mixture formed by the fuel injected from in-cylinder injector 110 is poor, and such inhomogeneous air-fuel mixture within the combustion chamber may lead to unstable combustion. Thus, the fuel injection ratio of the in-cylinder injector is increased in accordance with transition to a higher engine speed region where such a problem is unlikely to occur, whereas the fuel injection ratio of in-cylinder injector 110 is decreased in accordance with transition to a higher load region where such a problem is likely to occur. These changes in the DI ratio r are shown by crisscross arrows in FIGS. 13 and 14.

In this manner, variation in output torque of the engine attributable to the unstable combustion can be suppressed. It is noted that these measures are approximately equivalent to the measures to decrease the fuel injection ratio of in-cylinder injector 110 as the state of the engine moves toward the predetermined low speed region, or to increase the fuel injection ratio of in-cylinder injector 110 as the engine state moves toward the predetermined low load region. Further, in a region other than the region set forth above (indicated by the crisscross arrows in FIGS. 13 and 14), and in the region where fuel injection is carried out using only in-cylinder injector 110 (the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression end, whereby the antiknock performance is improved. Further, the decreased temperature of the combustion chamber allows the intake efficiency to be improved, leading to high power output.

The DI ratio setting in other regions according to the setting maps of FIGS. 13 and 14 is similar to that of FIG. 11 (warm state) and FIG. 12 (cold state). Therefore, detailed description thereof will not be repeated.

In engine 10 described in conjunction with FIGS. 11–14, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in totality is ignited in the combustion chamber to realize the stratified charge combustion. Even if the fuel injection timing of in-cylinder injector 110 is set in the intake stroke, stratified charge combustion can be realized if a rich air-fuel mixture can be located locally around the spark plug.

As used herein, the stratified charge combustion includes both the stratified charge combustion and semi-stratified charge combustion set forth below. In the semi-stratified charge combustion, intake manifold injector 120 injects fuel in the intake stroke to generate a lean and homogeneous air-fuel mixture in totality in the combustion chamber, and then in-cylinder injector 110 injects fuel in the compression stroke to generate rich air-fuel mixture around the spark plug, so as to improve the combustion state. Such a semi-stratified charge combustion is preferable in the catalyst warm-up operation for the following reasons. In the catalyst warm-up operation, it is necessary to considerably retard the ignition timing and maintain a favorable combustion state (idling state) so as to cause a high-temperature combustion gas to arrive at the catalyst. Further, a certain quantity of fuel must be supplied. If the stratified charge combustion is employed to satisfy these requirements, the quantity of the fuel will be insufficient. With the homogeneous combustion, the retarded amount for the purpose of maintaining favorable combustion is small as compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine described in conjunction with FIGS. 11–14, the fuel injection timing of in-cylinder injector 110 is preferably set in the intake stroke for the reason set forth below. It is to be noted that, for most of the fundamental region (here, the fundamental region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state), the fuel injection timing of in-cylinder injector 110 is set at the intake stroke. The fuel injection timing of in-cylinder injector 110, however, may be set temporarily in the compression stroke for the purpose of stabilizing combustion, as will be described hereinafter.

When the fuel injection timing of in-cylinder injector 110 is set in the compression stroke, the air-fuel mixture is cooled by the fuel injection during the period where the temperature in the cylinder is relatively high. This improves the cooling effect and, hence, the antiknock performance. Further, when the fuel injection timing of in-cylinder injector 110 is set in the compression stroke, the time required from the fuel injection to the ignition is short, so that the air current can be enhanced by the atomization, leading to an increase of the combustion rate. With the improvement of antiknock performance and the increase of combustion rate, variation in combustion can be obviated to allow improvement in combustion stability.

Furthermore, the DI ratio map for a warm state shown in FIG. 11 or 13 may be employed when in an OFF idling state (in the case where the accelerator peddle is depressed when the idle switch is OFF), independent of the temperature of engine 10 (in other words, in either a warm state or cold state). Specifically, in-cylinder injector 110 is employed in the low load region independent of a cold state or warm state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fuel supply apparatus for an internal combustion engine comprising:

first fuel injection means for injecting fuel into a cylinder of said internal combustion engine, second fuel injection means for injecting fuel into an intake manifold of said internal combustion engine, fuel injection ratio control means for controlling a fuel injection ratio of a fuel injection quantity between said first fuel injection means and second fuel injection means with respect to a total fuel injection quantity in said internal combustion engine based on a required condition of said internal combustion engine, a fuel pump boosting pressure of fuel to discharge a quantity corresponding to open/closure control of a metering valve, a fuel delivery pipe receiving and delivering to said first fuel injection means the fuel discharged from said fuel pump, a pressure measurement unit measuring fuel pressure in said fuel delivery pipe, and fuel pressure control means for controlling open/closure of said metering valve according to an insufficient fuel pressure with respect to a target pressure of the measured fuel pressure by said pressure measurement unit, wherein said fuel pressure control means controls open/closure of said metering valve such that fuel of boosted pressure is discharged from said fuel pump when said measured fuel pressure is not more than said target pressure even in an in-cylinder injection suppressing period during which fuel is not injected from said first fuel injection means.

2. The fuel supply apparatus for an internal combustion engine according to claim 1, wherein said fuel pressure control means comprises fuel pressure determination means for determining whether said measured fuel pressure is in a pressure ensured state or a pressure insufficient state by comparison between said measured fuel pressure and said target pressure during said in-cylinder injection suppressing period, first open and closure control means for controlling open/closure of said metering valve such that a quantity of fuel discharged from said fuel pump attains a predetermined fixed value when determination is made of said pressure insufficient state by said fuel pressure determination means, and second open and closure control means for controlling open/closure of said metering valve such that the quantity of fuel discharged from said fuel pump is substantially zero when determination is made of said pressure ensured state by said fuel pressure determination means.

3. The fuel supply apparatus for an internal combustion engine according to claim 2, wherein said target pressure during said in-cylinder injection suppressing period is set at a value differing between said pressure ensured state and said pressure insufficient state, and a target pressure in said pressure ensured state is set at a value lower than a target pressure in said pressure insufficient state.

4. The fuel supply apparatus for an internal combustion engine according to claim 1, wherein said fuel pressure control means controls open/closure of said metering valve according to setting of fuel injection quantity from said first fuel injection means, in addition to the insufficient fuel pressure of said measured fuel pressure.

5. A fuel supply apparatus for an internal combustion engine comprising:

first fuel injection means for injecting fuel into a cylinder of said internal combustion engine, second fuel injection means for injecting fuel into an intake manifold of said internal combustion engine, fuel injection ratio control means for controlling an injection ratio of a fuel injection quantity between said first fuel injection means and second fuel injection means with respect to total fuel injection quantity at said internal combustion engine based on a required condition of said internal combustion engine, a fuel pump boosting pressure of fuel and discharging a quantity according to open/closure control of a metering valve, a fuel delivery pipe for receiving and delivering to said first fuel injection means the fuel discharged from said fuel pump, a pressure measurement unit measuring pressure of fuel in said fuel delivery pipe, and fuel pressure control means for controlling open/closure of said metering valve according to insufficient fuel pressure with respect to the target pressure of the measured fuel pressure by said pressure measurement unit and a setting value of fuel injection quantity from said first fuel injection means.

6. The fuel supply apparatus for an internal combustion engine according to claim 5, wherein said fuel pressure control means calculates a fuel injection quantity setting value from said first fuel injection means according to a product of said total fuel injection quantity at said internal combustion engine and said fuel injection ratio set by said fuel injection ratio control means.

7. A fuel supply apparatus for an internal combustion engine comprising:

a first fuel injection mechanism for injecting fuel into a cylinder of said internal combustion engine, a second fuel injection mechanism for injecting fuel into an intake manifold of said internal combustion engine, a fuel injection ratio control portion for controlling a fuel injection ratio of a fuel injection quantity between said first fuel injection mechanism and second fuel injection mechanism with respect to a total fuel injection quantity in said internal combustion engine based on a required condition of said internal combustion engine, a fuel pump boosting pressure of fuel to discharge a quantity corresponding to open/closure control of a metering valve, a fuel delivery pipe receiving and delivering to said first fuel injection mechanism the fuel discharged from said fuel pump, a pressure measurement unit measuring fuel pressure in said fuel delivery pipe, and a fuel pressure control portion for controlling open/closure of said metering valve according to an insufficient fuel pressure with respect to a target pressure of the measured fuel pressure by said pressure measurement unit, wherein said fuel pressure control portion controls open/closure of said metering valve such that fuel of boosted pressure is discharged from said fuel pump when said measured fuel pressure is not more than said target pressure even in an in-cylinder injection suppressing period during which fuel is not injected from said first fuel injection mechanism.

8. The fuel supply apparatus for an internal combustion engine according to claim 7, wherein said fuel pressure control portion comprises a fuel pressure determination portion for determining whether said measured fuel pressure is in a pressure ensured state or a pressure insufficient state by comparison between said measured fuel pressure and said target pressure during said in-cylinder injection suppressing period, a first open and closure control portion for controlling open/closure of said metering valve such that a quantity of fuel discharged from said fuel pump attains a predetermined fixed value when determination is made of said pressure insufficient state by said fuel pressure determination portion, and a second open and closure control portion for controlling open/closure of said metering valve such that the quantity of fuel discharged from said fuel pump is substantially zero when determination is made of said pressure ensured state by said fuel pressure determination portion.

9. The fuel supply apparatus for an internal combustion engine according to claim 8, wherein said target pressure during said in-cylinder injection suppressing period is set at a value differing between said pressure ensured state and said pressure insufficient state, and a target pressure in said pressure ensured state is set at a value lower than a target pressure in said pressure insufficient state.

10. The fuel supply apparatus for an internal combustion engine according to claim 7, wherein said fuel pressure control portion controls open/closure of said metering valve according to setting of fuel injection quantity from said first fuel injection mechanism, in addition to the insufficient fuel pressure of said measured fuel pressure.

11. A fuel supply apparatus for an internal combustion engine comprising:

a first fuel injection mechanism for injecting fuel into a cylinder of said internal combustion engine, a second fuel injection mechanism for injecting fuel into an intake manifold of said internal combustion engine, an injection ratio control portion for controlling an injection ratio of a fuel injection quantity between said first fuel injection mechanism and second fuel injection mechanism with respect to a total fuel injection quantity at said internal combustion engine based on a required condition of said internal combustion engine, a fuel pump boosting pressure of fuel and discharging a quantity according to open/closure control of a metering valve, a fuel delivery pipe for receiving and delivering to said first fuel injection mechanism the fuel discharged from said fuel pump, a pressure measurement unit measuring pressure of fuel in said fuel delivery pipe, and a fuel pressure control portion for controlling open/closure of said metering valve according to insufficient fuel pressure with respect to the target pressure of the measured fuel pressure by said pressure measurement unit and a setting value of fuel injection quantity from said first fuel injection mechanism.

12. The fuel supply apparatus for an internal combustion engine according to claim 11, wherein said fuel pressure control portion calculates a fuel injection quantity setting value from said first fuel injection mechanism according to a product of said total fuel injection quantity at said internal combustion engine and said injection ratio set by said fuel injection ratio control portion.

* * * * *